US012708137B2

(12) United States Patent
Rostami et al.

(10) Patent No.: US 12,708,137 B2
(45) Date of Patent: Aug. 18, 2026

(54) FLAVOR CARRIERS FOR ELECTRONIC VAPING DEVICE

(71) Applicant: Altria Client Services LLC, Richmond, VA (US)

(72) Inventors: Ali A. Rostami, Richmond, VA (US); Dmitriy S. Kirzhner, Richmond, VA (US); Eric Hawes, Glen Allen, VA (US); Yezdi Pithawalla, Richmond, VA (US)

(73) Assignee: Altria Client Services LLC, Richmond, VA (US)

( * ) Notice: Subject to any disclaimer, the term of this patent is extended or adjusted under 35 U.S.C. 154(b) by 0 days.

(21) Appl. No.: 18/330,597

(22) Filed: Jun. 7, 2023

(65) Prior Publication Data

US 2023/0309604 A1 Oct. 5, 2023

Related U.S. Application Data

(63) Continuation of application No. 16/375,284, filed on Apr. 4, 2019, now Pat. No. 11,751,599.

(51) Int. Cl.

| | |
|---|---|
| ***A24B 15/167*** | (2020.01) |
| ***A24D 1/14*** | (2006.01) |
| ***A24F 7/00*** | (2006.01) |

(52) U.S. Cl.

CPC ..... *A24B 15/167* (2016.11); *A24D 1/14* (2013.01); *A24F 7/00* (2013.01)

(58) Field of Classification Search

None

See application file for complete search history.

(56) References Cited

U.S. PATENT DOCUMENTS

| | | | |
|---|---|---|---|
| 4,123,592 | A | 10/1978 | Rainer et al. |
| 7,578,298 | B2 | 8/2009 | Karles et al. |
| 7,878,962 | B2 | 2/2011 | Karles et al. |
| 9,004,073 | B2 | 4/2015 | Tucker et al. |
| 9,289,014 | B2 | 3/2016 | Tucker et al. |

(Continued)

FOREIGN PATENT DOCUMENTS

| | | | |
|---|---|---|---|
| CN | 106263039 | A | 1/2017 |
| CN | 108697170 | A | 10/2018 |

(Continued)

OTHER PUBLICATIONS

Russian Office action and Search Report for Application No. 2021131717, dated Jun. 1, 2023, with English translation included.

(Continued)

*Primary Examiner* — Katherine A Will

(74) *Attorney, Agent, or Firm* — Harness, Dickey & Pierce, P.L.C.

(57) ABSTRACT

A cartridge of an electronic vaping device includes a flavor carrier. The flavor carrier includes an outer housing extending in a longitudinal direction, an inner housing extending in the longitudinal direction, and a flavor chamber between the outer housing and the inner housing. The outer housing includes at least one outer housing perforation defined in a wall of the outer housing. The inner housing includes at least one inner housing perforation defined in a wall of the inner housing. The flavor chamber is configured to contain a flavoring material.

20 Claims, 6 Drawing Sheets

(56) References Cited

U.S. PATENT DOCUMENTS

| | | | | |
|---|---|---|---|---|
| 11,083,229 | B2 | 8/2021 | Holtz et al. | |
| 11,464,081 | B2 | 10/2022 | Holtz | |
| 2013/0037041 | A1 | 2/2013 | Worm et al. | |
| 2013/0192623 | A1 | 8/2013 | Tucker et al. | |
| 2014/0261486 | A1 | 9/2014 | Potter et al. | |
| 2015/0027468 | A1 | 1/2015 | Li et al. | |
| 2016/0066617 | A1 | 3/2016 | Yilmaz et al. | |
| 2017/0251722 | A1* | 9/2017 | Kobal | A24F 40/42 |
| 2017/0311648 | A1 | 11/2017 | Gill et al. | |
| 2017/0325503 | A1 | 11/2017 | Liu | |
| 2018/0027875 | A1 | 2/2018 | Rostami et al. | |
| 2018/0070641 | A1 | 3/2018 | Batista et al. | |
| 2018/0184710 | A1 | 7/2018 | Tucker et al. | |
| 2018/0368474 | A1 | 12/2018 | Bache et al. | |

FOREIGN PATENT DOCUMENTS

| | | | |
|---|---|---|---|
| CN | 109043640 | A | 12/2018 |
| EP | 2358418 | A1 | 8/2011 |
| GB | 2513631 | A | 11/2014 |
| JP | 2016-516441 | A | 6/2016 |
| JP | 2017-533732 | A | 11/2017 |
| JP | 2018/533971 | A | 11/2018 |
| JP | 2020-524502 | A | 8/2020 |
| RU | 2604313 | C2 | 12/2016 |
| RU | 2637980 | C2 | 12/2017 |
| RU | 2670043 | C1 | 10/2018 |
| RU | 2675712 | C1 | 12/2018 |
| WO | WO-2014/110119 | A1 | 7/2014 |
| WO | WO-2014/177696 | A1 | 11/2014 |
| WO | WO-2015/040180 | A2 | 3/2015 |
| WO | WO-2016/075436 | A1 | 5/2016 |
| WO | WO-2017/207418 | A1 | 12/2017 |
| WO | WO-2018/122380 | A1 | 7/2018 |
| WO | 2018/234585 | A1 | 12/2018 |
| WO | 2019/012151 | A1 | 1/2019 |

OTHER PUBLICATIONS

Notice of Allowance dated Oct. 10, 2023 issued in related Russian patent application No. 2021131717.
Office Action dated Aug. 18, 2023 issued in related Chinese patent application No. 202080020133.9.
International Search Report and Written Opinion for corresponding Application No. PCT/EP2020/058596, dated May 19, 2020.
Written Opinion of the International Preliminary Examining Authority issued Feb. 23, 2021 in International Application No. PCT/EP2020/058596.
International Preliminary Report on Patentability dated May 4, 2021 for corresponding International Application No. PCT/EP2020/058596.
Office Action dated Jan. 13, 2024 issued in related Chinese patent application No. 202080020133.9.
Office Action dated May 13, 2024 issued in Japanese Patent Application No. 2021-556264.
Office Action dated Nov. 14, 2023 issued in related Brazilian patent application No. 1120210173951.
Office Action dated Jun. 6, 2024 issued in Chinese Patent Application No. 202080020133.9.
Decision to Grant dated Aug. 22, 2024 issued in Japanese Patent Application No. 2021-556264.
Office Action dated Dec. 7, 2024 issued in Korean patent application No. 10-2021-7032420.
Decision to Grant dated Dec. 17, 2024 issued in Japanese Patent Application No. 2021-559045.
Office Action dated Dec. 9, 2024 issued in Chinese patent application No. 202080040255.4.
Notice of Allowance dated Aug. 4, 2025 issued in Korean patent application No. 10-2021-7032420.
Office Action dated Jun. 2, 2025 issued in Europeant patent application No. 22700740.8.
Extended European Search Report dated Feb. 6, 2025 issued in European patent application No. 24201781.2.
Office Action dated Aug. 26, 2025 issued in Japanese Patent Application No. 2025-005986.
Office Action dated Aug. 25, 2025 issued in U.S. Appl. No. 18/306,368.
Office Action dated Jul. 18, 2024 issued in Chinese patent application No. 202080040255.4.
Notice of Reasons for Rejection dated May 7, 2024 issued in Japanese patent application No. 2021-559045.
Office Action dated Jan. 10, 2024 issued in Chinese patent application No. 202080040255.4.
Office Action dated Dec. 20, 2021 issued in Chinese patent application No. 202080040255.4.
Office Action dated Nov. 10, 2022 issued European patent application No. 20722014.6.
Office Action dated Jan. 6, 2026 issued in Japanese patent application No. 2025-005986.
Examination Report dated Jan. 21, 2026 issued in European Patent Application No. 24201781.2.
Office Action dated Dec. 2, 2025 issued in Brazilian patent application No. 1120210173951.
Office Action dated Jan. 26, 2026 issued in U.S. Appl. No. 18/306,368.
Office Action dated May 6, 2026 issued in U.S. Appl. No. 18/306,368.

* cited by examiner

FLAVOR CARRIERS FOR ELECTRONIC VAPING DEVICE

CROSS-REFERENCE TO RELATED APPLICATION

This application is a continuation of U.S. application Ser. No. 16/375,284, filed Apr. 4, 2019, the entire contents of which is incorporated herein by reference thereto.

BACKGROUND

Field

The present disclosure relates to an electronic vaping device including a flavor carrier.

Description of Related Art

An electronic vaping or e-vaping device can include a heating element that vaporizes a pre-vapor formulation to produce a vapor.

An e-vaping device can further include a power supply, such as a rechargeable battery, arranged in the device. The power supply is electrically connected to the heating element. The power supply provides power to the heating element such that the heating element heats to a temperature sufficient to convert the pre-vapor formulation to a vapor. The vapor exits the e-vaping device through an outlet.

SUMMARY

At least one example embodiment relates to a cartridge of an electronic vaping device.

In at least one example embodiment, a cartridge of an electronic vaping device includes an outer cartridge housing extending in a longitudinal direction, a vaporizer in the outer cartridge housing, and a flavor carrier in the outer cartridge housing. The flavor carrier includes an outer housing extending in a longitudinal direction, an inner housing extending in the longitudinal direction, and a flavor chamber between the outer housing and the inner housing. The outer housing includes at least one outer housing perforation defined in a wall of the outer housing. The inner housing is coaxial with the outer housing. The inner housing includes at least one inner housing perforation defined in a wall of the inner housing. The flavor chamber is configured to contain a flavoring material.

In at least one example embodiment, the cartridge includes a mouthpiece at a first end of the outer cartridge housing.

In at least one example embodiment, the flavor carrier further comprises a cover at an end of the flavor carrier. The cover is configured to secure the flavor carrier within the cartridge, the outer flavor carrier housing having a smaller outer diameter than an inner diameter of the outer cartridge housing. The cover defines a channel therein, the channel in fluid communication with an air passage defined by the inner flavor carrier housing. The cartridge may further include a cover at a second end of the flavor carrier. The cover is formed of one or more materials including a polymer, a metal, or both a polymer and a metal, the cover being substantially impermeable to vapor. The cover at the second end is a gasket. The gasket is substantially impermeable to vapor.

The gasket is formed of one or more materials including a polymer, a metal, or both a polymer and a metal.

In at least one example embodiment, at least one of the wall of the outer flavor carrier housing and the wall of the inner flavor carrier housing has a thickness ranging from about 0.5 mm to about 1.5 mm. At least one of the wall of the outer flavor carrier housing and the wall of the inner flavor carrier housing is formed of at least one of paper, a fabric, a metal, and a polymer.

In at least one example embodiment, the flavoring material is in the flavor chamber. The flavoring material includes a botanical material, a gel, a film, flavor bits, a powder, a compressed powder, a flavor bead, a sub-combination thereof, or a combination thereof.

In at least one example embodiment, the flavor carrier is between the vaporizer and a mouth end of the cartridge.

At least one example embodiment relates to an electronic vaping device.

In at least one example embodiment, an electronic vaping device comprises an outer cartridge housing extending in a longitudinal direction, a vaporizer in the outer cartridge housing, a flavor carrier in the outer cartridge housing, and a power supply configured to supply power to the vaporizer. The flavor carrier is between the vaporizer and a mouth end of the electronic vaping device. The flavor carrier includes an outer flavor carrier housing extending in the longitudinal direction, the outer flavor carrier housing including, at least one outer flavor carrier housing perforation defined by a wall of the outer flavor carrier housing, an inner flavor carrier housing extending in the longitudinal direction, the inner flavor carrier housing coaxial with the outer flavor carrier housing, the inner flavor carrier housing including at least one inner flavor carrier housing perforation defined by a wall of the inner flavor carrier housing, and a flavor chamber between the outer flavor carrier housing and the inner flavor carrier housing. The flavor chamber is configured to contain a flavoring material.

In at least one example embodiment, the electronic vaping device comprises a mouthpiece at a first end of the outer cartridge housing.

In at least one example embodiment, the electronic vaping device further comprises the flavoring material in the flavor chamber. The flavoring material includes a botanical material, a gel, a film, flavor bits, a powder, a compressed powder, a flavor bead, a sub-combination thereof, or a combination thereof.

BRIEF DESCRIPTION OF THE DRAWINGS

The various features and advantages of the non-limiting embodiments herein may become more apparent upon review of the detailed description in conjunction with the accompanying drawings. The accompanying drawings are merely provided for illustrative purposes and should not be interpreted to limit the scope of the claims. The accompanying drawings are not to be considered as drawn to scale unless explicitly noted. For purposes of clarity, various dimensions of the drawings may have been exaggerated.

DETAILED DESCRIPTION OF EXAMPLE EMBODIMENTS

Figure 1:
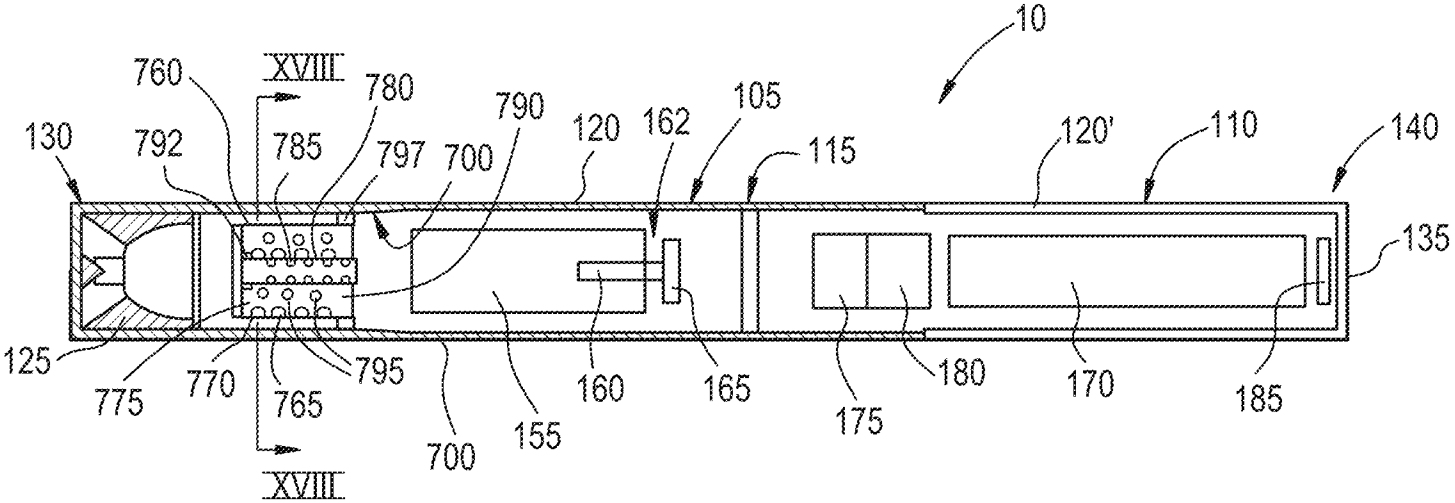
FIG. 1 is a cross-sectional view of an e-vaping device according to at least one example embodiment.

Some detailed example embodiments are disclosed herein. However, specific structural and functional details disclosed herein are merely representative for purposes of describing example embodiments. Example embodiments may, however, be embodied in many alternate forms and should not be construed as limited to only the example embodiments set forth herein.

Accordingly, while example embodiments are capable of various modifications and alternative forms, example embodiments thereof are shown by way of example in the drawings and will herein be described in detail. It should be understood, however, that there is no intent to limit example embodiments to the particular forms disclosed, but to the contrary, example embodiments are to cover all modifications, equivalents, and alternatives thereof. Like numbers refer to like elements throughout the description of the figures.

It should be understood that when an element or layer is referred to as being "on," "connected to," "coupled to," "attached to," "adjacent to," or "covering" another element or layer, it may be directly on, connected to, coupled to, attached to, adjacent to or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations or sub-combinations of one or more of the associated listed items.

It should be understood that, although the terms first, second, third, etc. may be used herein to describe various elements, components, regions, layers and/or sections, these elements, components, regions, layers, and/or sections should not be limited by these terms. These terms are only used to distinguish one element, component, region, layer, or section from another region, layer, or section. Thus, a first element, component, region, layer, or section discussed below could be termed a second element, component, region, layer, or section without departing from the teachings of example embodiments.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various example embodiments only and is not intended to be limiting of example embodiments. As used herein, the singular forms "a," "an," and "the" are intended to include the plural forms as well, unless the context clearly indicates otherwise. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

When the words "about" and "substantially" are used in this specification in connection with a numerical value, it is intended that the associated numerical value include a tolerance of ±10% around the stated numerical value, unless otherwise explicitly defined.

Vapor, aerosol and dispersion are used interchangeably, and refer to the matter generated or outputted by the devices disclosed, claimed and/or equivalents thereof.

Unless otherwise defined, all terms (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

FIG. 1 is a cross-sectional view of an e-vaping device according to at least one example embodiment.

Referring to FIG. 1, in at least one example embodiment, an electronic vaping device (e-vaping device) 10 includes a replaceable cartridge (or first section) 105 and a reusable battery section (or second section) 110. The first section 105 and the second section 110 may be coupled together at a connector assembly 115.

In the example embodiment shown in FIG. 1, the first section 105 includes a first housing 120 and the second section 110 includes a second housing 120'. The e-vaping device 10 includes a mouth-end insert 125 at a first end 130, and an end cap 135 at a second end 140.

According to at least one example embodiment, the first housing 120 and the second housing 120' may have any desired cross-sectional shape. As discussed herein, the housings 120, 120' may also be referred to as outer or main housings.

Although example embodiments may be described in some instances with regard to the first section 105 coupled to the second section 110, example embodiments should not be limited to these examples.

In at least one example embodiment, the e-vaping device 10 includes a reservoir 155 configured to hold a pre-vapor formulation, and a vaporizer 162 configured to form a vapor.

The vaporizer 162 may include a wick 160 configured to wick the pre-vapor formulation from the reservoir 155, and a heating element 165 configured to heat the pre-vapor formulation to form a vapor. The reservoir 155, the wick 160, and the heating element 165 may be any suitable reservoir, wick, or heating element generally known to a person having ordinary skill in the art.

In at least one example embodiment, the e-vaping device 10 also includes a battery 170, control circuitry 175, a sensor 180, and a light emitting diode (LED) 185 as generally known to a person having ordinary skill in the art.

The e-vaping device 10 may include the features set forth in U.S. Patent Application Publication No. 2013/0192623 to Tucker et al. filed Jan. 31, 2013 and/or features set forth in U.S. patent application Ser. No. 15/135,930 to Holtz et al. filed Apr. 22, 2016, the entire contents of each of which are incorporated herein by reference thereto. In other example embodiments, the e-vaping device may include the features set forth in U.S. patent application Ser. No. 15/135,923 filed Apr. 22, 2016, and/or U.S. Pat. No. 9,289,014 issued Mar. 22, 2016, the entire contents of each of which is incorporated herein by this reference thereto.

In at least one example embodiment, as shown in FIG. 1, the e-vaping device 10 may include a flavor carrier 760. The flavor carrier 760 may include an outer housing 765 extending in the longitudinal direction, an inner housing 780 extending in the longitudinal direction, and a flavor chamber 790 between the outer housing 765 and the inner housing 780. The outer housing 765 and/or the inner housing 780 may be generally cylindrical. In other example embodiments, a cross-section of outer housing 765 and/or the inner housing 780 may be generally rectangular, oval, square, triangular, polygonal and/or may have any other cross-sectional shape. In some example embodiments, a cross section of outer housing 765 may have generally the same shape than a cross section of inner housing 780. In some example embodiments, a cross section of outer housing 765 may have a different shape than a cross section of inner housing 780. The outer housing 765 includes at least one outer housing perforation 770 defined in a wall 775 of the outer housing 765. In an example embodiment, the inner housing 780 is coaxial with the outer housing 765. In other example embodiments, the inner housing 780 is not coaxial with the outer housing 765. In some example embodiments, the inner housing 780 is within the outer housing 765. In some example embodiments, at least a portion of the inner housing 780 is within at least a portion of the outer housing 765. In some example embodiments, an area of a cross-section of the inner housing 780 is smaller than an area of a cross-section of the outer housing 765. In some example embodiments, a cross section of the inner housing 780 is generally circular and a cross section of the outer housing 765 is generally circular, and a diameter of the cross section of the inner housing 780 is smaller than a diameter of the cross section of the outer housing 765. Other arrangements or variations may be used in other example embodiments. The inner housing 780 includes at least one inner housing perforation 785 defined in a wall 792 of the inner housing 780. The flavor chamber 790 is configured to contain a flavoring material 795.

In at least one example embodiment, an adapter 797 is at an end of the flavor carrier 760. The adapter 797 is configured to secure the flavor carrier 760 within a housing 120 of an e-vaping device 10. The adapter 797 may be a ring-shaped body, or have another shape that fits snugly about an outer surface of the outer housing 765 of the flavor carrier 760. The adapter 797 is sized to friction fit between the outer housing 765 of the flavor carrier 760 and an inner surface 700 of the housing 120 of the e-vaping device 10.

In at least one example embodiment, the adapter 797 is formed of one or more materials including a polymer, a metal, or a combination thereof, and/or any other suitable materials. The adapter 797 is substantially impermeable to vapor so that the vapor is forced to flow through the flavor carrier 760, where the aromas and/or flavors from flavor material 795 are eluted to the vapor.

In at least one example embodiment, the outer housing 765 of the flavor carrier 760 is a hollow cylinder having an outer diameter ranging from about 3.0 mm to about 10.0 mm (e.g., about 3.0 mm to about 5.0 mm, about 3.5 mm to about 4.5 mm, about 3.75 mm to about 4.25 mm, etc.). In other example embodiments, the outer housing 765 of the flavor carrier 760 is a hollow cylinder having an outer diameter that is less than about 3.0 mm, or greater than about 10.0 mm.

In at least one example embodiment, the inner housing 780 is a hollow cylinder having an outer diameter ranging from about 1.0 mm to about 3.0 mm (e.g., about 1.5 mm to about 2.5 mm, about 1.75 mm to about 2.25 mm, etc.). In other example embodiments, the inner housing 780 of the flavor carrier 760 is a hollow cylinder having an outer diameter that is less than about 1.0 mm, or greater than about 3.0 mm. The diameter of the inner housing 780 and the outer housing 765 may be chosen to provide a desired volume of the flavor chamber 790 defined between the inner housing 780 and the outer housing 765.

In at least one example embodiment, wall 775 of the outer housing 765, wall 792 of the inner housing 780, or each have a thickness ranging from about 0.5 mm to about 1.5 mm (e.g., about 0.75 mm to about 1.25 mm). In some example embodiments, wall 775 and/or wall 792 have thicknesses that are smaller than about 0.5 mm, or greater than about 1.5 mm. In some example embodiments, the wall 775 of the outer housing 765, the wall 792 of the inner housing 780, or both are formed of one or more materials that include paper, a fabric, a metal, a polymer and/or any other suitable materials.

In at least one example embodiment, the flavoring material 795 includes a botanical material, a gel, a film, flavor bits, powders, discs of compressed powders, a flavor bead and/or any other flavoring materials. In some example embodiments, the botanical material may include tobacco, plant material and/or other botanical material. In other example embodiments, the botanical material may include non-tobacco botanical material, such as teas, herbs, etc.

In some example embodiments, the flavoring material 795 may include a gel. The gel may include a polymer, one or more flavorants and/or botanical material suspended in the gel.

In other example embodiments, the flavoring material 795 may include a film. The film may be formed of at least one polymer and one or more flavorants. The film or films may be in flavor chamber 790, rolled around the inner housing 780 and/or provided in a tube form, such that the tube is inserted in flavor chamber 790 around the inner housing 780. In some examples, the film may be water soluble and/or may disintegrate when exposed to heat, such that the film disintegrates as vapor passes through the flavor chamber 790. In other examples, the film may be porous. Other types of films may be used.

In some example embodiments, the flavoring material 795 includes flavor beads include at least one polymer and at least one flavorant. The flavor beads may include an outer shell enclosing an inner core. The inner core and/or the outer shell may contain menthol or other volatile flavors. For example, the inner core can contain mint flavors such as peppermint, spearmint or any other flavors.

In at least one example embodiment, the flavor beads can each have a diameter ranging from about 0.5 mm to about 5 mm (e.g., about 1 mm about 4 mm, about 2 mm to about 3 mm, etc.). In other example embodiments, the flavor beads can each have a diameter that is smaller than about 0.5 mm or greater than about 5 mm. The flavor beads can be manufactured and/or include the features of the flavor beads and/or flavor capsules disclosed in U.S. Pat. No. 7,878,962 to Karles et al., which issued Feb. 1, 2011, and U.S. Pat. No. 7,578,298 to Karles et al., which issued Aug. 25, 2009, the entire content of each of which is incorporated herein by this reference thereto.

In at least one example embodiment, the flavoring material 795 is in the form of a paper impregnated and/or coated with one or more flavorants.

In some example embodiments, where the flavoring material 795 is a film or paper, the film or paper may be chopped before being placed in the flavor chamber 790. In some example embodiments, the chopped film or paper may be mixed with at least one botanical material and/or with flavor beads.

In at least one example embodiment, the flavoring material 795 may be coated with a second material including at least one polymer and/or a flavorant. A flavorant of the coating may be the same flavorant incorporated in the flavoring material 795 underlying the coating or the flavorant of the coating may be a different flavorant that the flavorant in the underlying flavoring material 795. In at least one example embodiment, the flavoring material 795 includes cellulose material with one or more flavorants.

In at least one example embodiment, a flavorant is a volatile flavorant. In at least one example embodiment, the flavorant may be any flavorant commonly used in foods, confections, or other oral products. Example flavorants include, but are not limited to, berry flavors such as pomegranate, acai, raspberry, blueberry, strawberry, boysenberry, cranberry, etc. Other example flavorants include, without limitation, any natural or synthetic flavor or aroma, such as menthol, peppermint, spearmint, wintergreen, bourbon, scotch, whiskey, cognac, hydrangea, lavender, chocolate, licorice, citrus and other fruit flavors, such as apple, peach, pear, cherry, plum, orange, lime, grape, and grapefruit, gamma octalactone, vanillin, ethyl vanillin, breath freshener flavors, butter, rum, coconut, almond, pecan, walnut, hazelnut, French vanilla, macadamia, sugar cane, maple, cassis, caramel, banana, malt, espresso, kahlua, white chocolate, spice flavors such as cinnamon, clove, cilantro, basil, oregano, garlic, mustard, nutmeg, rosemary, thyme, tarragon, dill, sage, anise, and fennel, methyl salicylate, linalool, jasmine, coffee, olive oil, sesame oil, sunflower oil, bergamot oil, geranium oil, lemon oil, ginger oil, balsamic vinegar, rice wine vinegar, red wine vinegar, etc. One or more flavorants may be included in flavoring materials 795.

In at least one example embodiment, the flavoring material 795 includes a polymer and the polymer is a water soluble or water insoluble polymer. The polymer may be natural or synthetic. The polymers may be a hydrocolloid. Other example polymers include, without limitation, starch, dextrin, gum arabic, guar gum, chitosan, cellulose, polyvinyl alcohol, polylactide, gelatin, soy protein, whey protein, etc.

Figure 2:
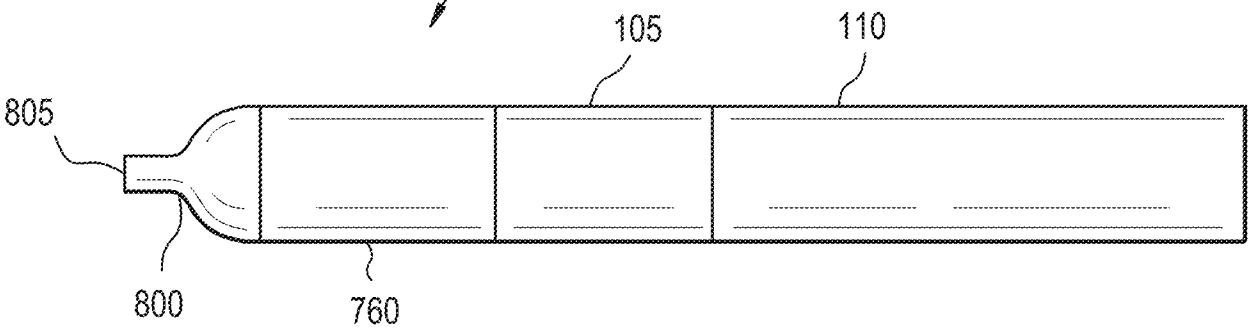
FIG. 2 is a schematic view of an electronic vaping device according to at least one example embodiment.

FIG. 2 is schematic view of an electronic vaping device according to at least one example embodiment.

In at least one example embodiment, as shown in FIG. 2, the e-vaping device 10' includes a mouthpiece 800, and the mouthpiece 800 may include and/or be attached to the flavor carrier 760. The mouthpiece may be removable and may fit with an end of the e-vaping device 10' or a portion of the flavor carrier 760. The mouthpiece 800 may include one or more outlets 805, and in some examples may have a tapered end.

In at least one example embodiment, the mouthpiece 800 is formed of materials that include plastic, metal, wood and/or other suitable materials. In at least one example embodiment, the mouthpiece 800 is formed from at least one plastic material, such as polyethylene or polypropylene. The mouthpiece 800 may be rounded, and may not include any sharp edges. In other example embodiments, the cross-section of a mouthpiece 800 may be generally rectangular, oval, square, triangular, polygonal and/or may have any other cross-sectional shape. In some example embodiments, a mouthpiece 800 may include sharp edges. In some example embodiments, a surface of the mouthpiece 800 may be generally smooth.

Figure 3:
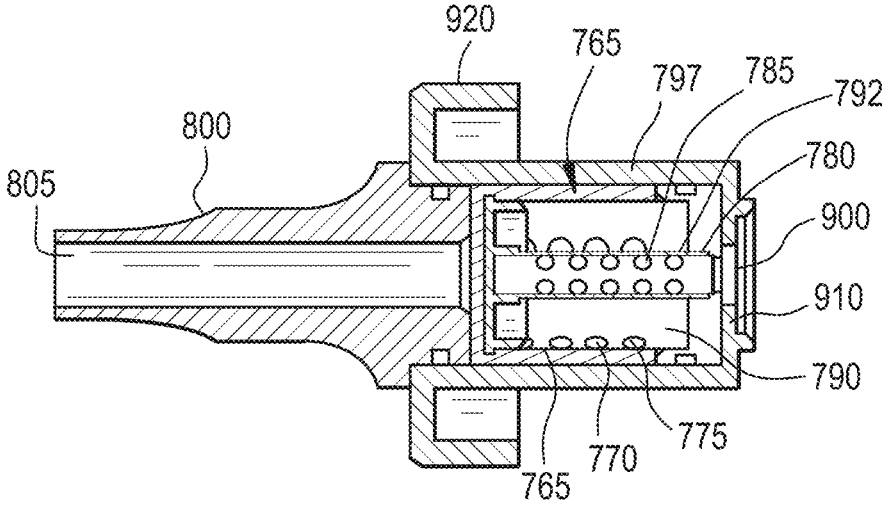
FIG. 3 is a cross-sectional view of a flavor carrier and mouthpiece according to at least one example embodiment.

FIG. 3 is a cross-sectional view of a flavor carrier and mouthpiece according to at least one example embodiment.

In at least one example embodiment, as shown in FIG. 3, one or more features of a flavor carrier 760 are generally the same as one or more features of the flavor carrier in FIG. 1, and adapter 797 surrounds at least a portion of the flavor carrier 760 and a mouthpiece 800 fits with an end of the adapter 797. This adapter 797 of the example shown in FIG. 3 is generally U-shaped and cylindrical, such that the flavor carrier 760 nests within the adapter 797. A bottom wall 910 of the adapter 797 defines a channel 900 that directs vapor into the flavor carrier 760 when the flavor carrier 760 and adapter are engaged with, and/or within an e-vaping device, downstream of a vaporizer that generates a vapor. The adapter 797 can also include a flange portion 920 that engages with a housing of an e-vaping device. Thus, the flavor carrier 760 of FIG. 3 may be placed at a mouth-end of an e-vaping device, and in some examples may be even retrofitted with an e-vaping device by removing an existing mouthpiece of the e-vaping device and inserting the adapter 797 within the housing of the e-vaping device at the mouth-end.

Figure 4:
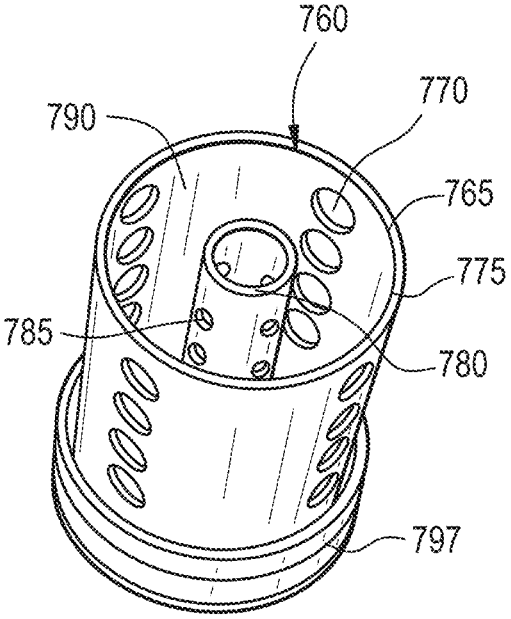
FIG. 4 is a perspective view of a flavor carrier according to at least one example embodiment.

FIG. 4 is a perspective view of a flavor carrier according to at least one example embodiment.

In at least one example embodiment, as shown in FIG. 4, one or more features of a flavor carrier 760 are generally the same as one or more features of the flavor carrier in FIG. 1, and perforations 785 in the wall 792 of the inner housing 780 are aligned with the perforations 770 in the wall 775 of the outer housing 765. The perforations 785 and the perforations 770 may be arranged in columns. In other example embodiments, the perforations 785 in the wall 792 of the inner housing 780 are not aligned with the perforations 770 in the wall 775 of the outer housing 765. In some example embodiments, the wall 792 and/or the wall 775 may each include 1 to about 20 columns (e.g., about 2 to about 18, about 4 to about 16, about 6 to about 14, about 8 to about 12, or about 10 to about 12) of perforations 770, 785. In some example embodiments, the wall 792 and/or the wall 775 may each include more than 20 columns. In some example embodiments, each column of perforations 770, 785 in the wall 792 and/or the wall 775 may include 1 to about 20 perforations 770, 785 (e.g., about 2 to about 18, about 4 to about 16, about 6 to about 14, about 8 to about 12, or about 10 to about 12). In some example embodiments, each column of perforations 770, 785 in the wall 792 and/or the wall 775 may include more than 20 perforations. The perforations 770, 785 may be a same or different size. The perforations 770, 785 may be generally circular in shape in some example embodiments, or may be triangular, rectangular, oval, square, polygonal or may have any other shape. The perforations 770 may be the same or different size and/or shape than perforations 785. In some example embodiments, the perforations 770, 785 may be larger at a first end of the flavor carrier 760 than at a second end of the flavor carrier 760. In at least one example embodiment, the perforations 770, 785 at a center of the flavor carrier 760 may be larger or smaller than the perforations 770, 785 at ends of the flavor carrier. In at least one example embodiment, each the perforations 770, 785 have substantially the same diameter (e.g., about 0.1 in diameter to about 5.0 mm in diameter).

Figure 5:
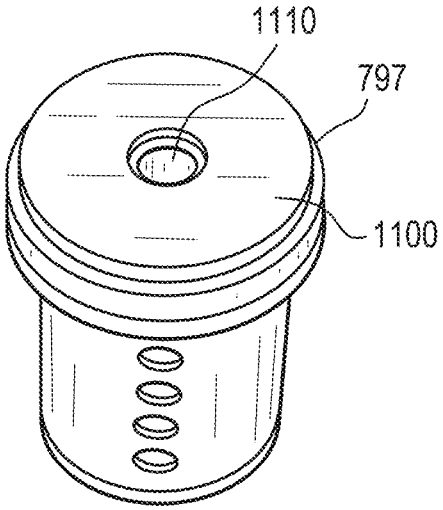
FIG. 5 is a perspective view of a flavor carrier according to at least one example embodiment.

FIG. 5 is a perspective view of a flavor carrier according to at least one example embodiment.

In at least one example embodiment, as shown in FIG. 5, one or more features of a flavor carrier 760 are generally the same as one or more features of the flavor carrier in FIG. 1, and adapter 797 is in the form of a cover 1100 that is placed over an end of the flavor carrier 760. The cover 1100 also defines a channel 1110 therein. The channel 1110 is in fluid communication with an air passage defined in the inner housing 780 of the flavor carrier 760, such that vapor is directed into the inner housing 780, then through the perforations 785 in the wall 792 of the inner housing 780 and into the flavor chamber 790. The vapor may then flow out of the flavor chamber 790 via the perforations 770 in the wall 775 of the outer housing 765.

Figure 6:
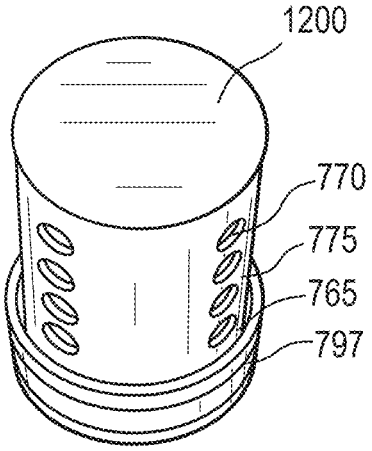
FIG. 6 is a perspective view of a flavor carrier according to at least one example embodiment.

FIG. 6 is a perspective view of a flavor carrier according to at least one example embodiment.

In at least one example embodiment, as shown in FIG. 6, one or more features of a flavor carrier 760 are generally the same as one or more features of the flavor carrier in FIG. 5, and the flavor carrier 760 further comprises a gasket 1200 at a second end of the flavor carrier 760. The gasket 1200 is substantially impermeable to vapor, so as to force vapor to pass through the perforations 770 in the wall 775 of the outer housing 765 of the flavor carrier 760. The gasket 1200 is formed of one or more materials including a polymer, a metal or a combination thereof, and/or other suitable materials. In at least one example embodiment, the gasket 1200 is formed of one or more materials that include a food-grade, GRAS (generally recognized as safe) material.

Figure 7:
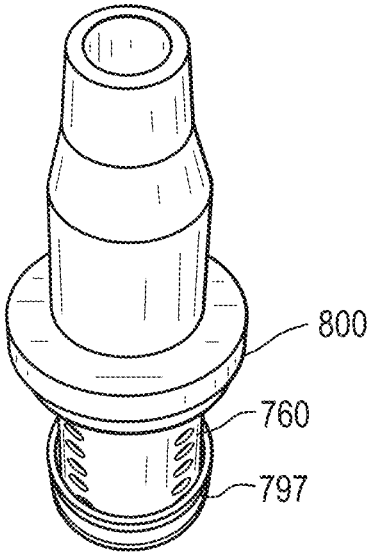
FIG. 7 is a perspective view of a flavor carrier according to at least one example embodiment.

FIG. 7 is a perspective view of a flavor carrier and a mouthpiece according to at least one example embodiment. In at least one example embodiment, as shown in FIG. 7, the mouthpiece 800 fits around an end portion of the flavor carrier 760.

Figure 8:
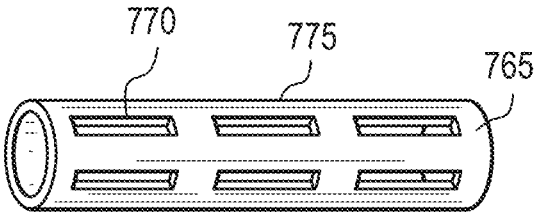
FIG. 8 is a perspective view of a flavor carrier according to at least one example embodiment.

FIG. 8 is a perspective view of an outer housing of a flavor carrier according to at least one example embodiment. In at least one example embodiment, as shown in FIG. 8, perforations 770 of outer housing 765 are elongated and extend parallel to the longitudinal direction of the flavor carrier 760. As shown, the perforations 770 may be generally rectangular in shape. In an example embodiment, the perforations 785 of inner housing 780, not shown, may be the same or different than the perforations 770 shown in FIG. 8, for example, in shape, size and/or pattern, etc. The perforations 785 may align with the perforations 770 and may be about a same size. In other example embodiments, the perforations 785 may have a different size and/or may not align with the perforations 770.

Figure 9:
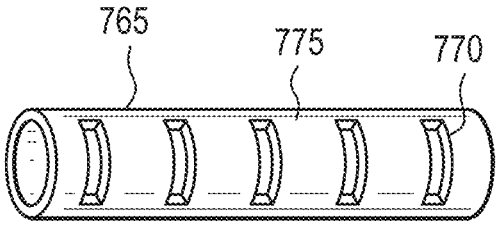
FIG. 9 is a perspective view of a flavor carrier according to at least one example embodiment.

FIG. 9 is a perspective view of an outer housing of a flavor carrier according to at least one example embodiment. In at least one example embodiment, as shown in FIG. 9, perforations 770 of outer housing 765 are elongated and extend perpendicular to the longitudinal direction of the flavor carrier 760. In an example embodiment, the perforations 785 of inner housing 780, not shown, may be the same or different than the perforations 770 shown in FIG. 9, for example, in shape, size and/or pattern, etc. The perforations 785 may align with the perforations 770 and may be about a same size. In other example embodiments, the perforations 785 may have a different size and/or may not align with the perforations 770.

Figure 10:
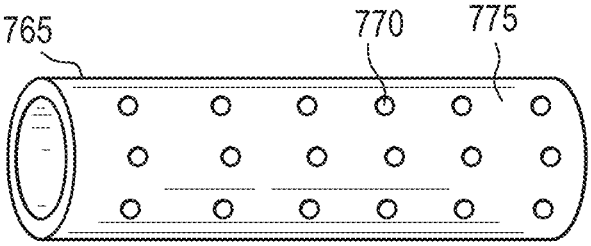
FIG. 10 is a perspective view of a flavor carrier according to at least one example embodiment.

FIG. 10 is a perspective view of an outer housing of a flavor carrier according to at least one example embodiment. In at least one example embodiment, as shown in FIG. 10, the perforations 770 of outer housing 765 are generally circular or oval in shape and are arranged in uniform rows and/or columns along outer housing 765. In an example embodiment, the perforations 785 of inner housing 780, not shown, may be the same or different than the perforations 770 shown in FIG. 10, for example, in shape, size and/or pattern, etc. The perforations 785 may align with the perforations 770 and may be about a same size. In other example embodiments, the perforations 785 may have a different size and/or may not align with the perforations 770.

Figure 11:
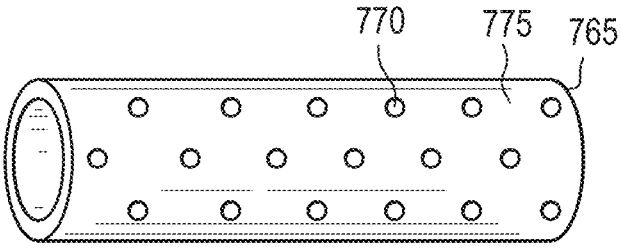
FIG. 11 is a perspective view of a flavor carrier according to at least one example embodiment.

FIG. 11 is a perspective view of an outer housing a flavor carrier of according to at least one example embodiment. In at least one example embodiment, as shown in FIG. 11, perforations 770 of outer housing 765 are generally circular or oval in shape and are arranged in offset rows along outer housing 765. In an example embodiment, the perforations 785 of inner housing 780, not shown, may be the same or different than the perforations 770 shown in FIG. 11, for example, in shape, size and/or pattern, etc. The perforations 785 may align with the perforations 770 and may be about a same size. In other example embodiments, the perforations 785 may have a different size and/or may not align with the perforations 770.

Figure 12:
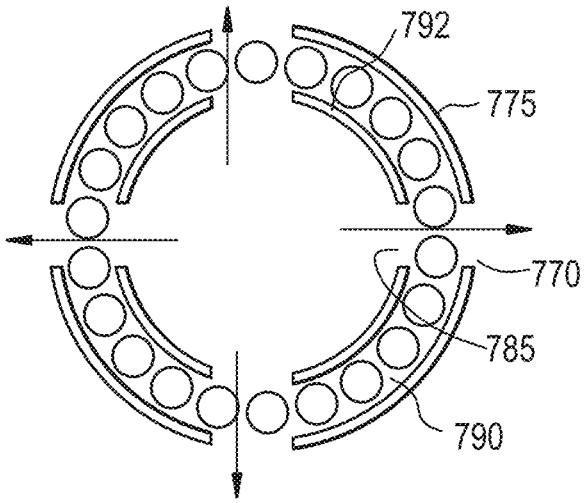
FIG. 12 is a cross-sectional view of a flavor cartridge according at least one example embodiment.

FIG. 12 is a cross-sectional view of a flavor cartridge according at least one example embodiment.

As shown in FIG. 12, in some example embodiments, the perforations 785 in the wall 792 of the inner housing 780 align with the perforations 770 in the wall 775 of the outer housing 765.

Figure 13:
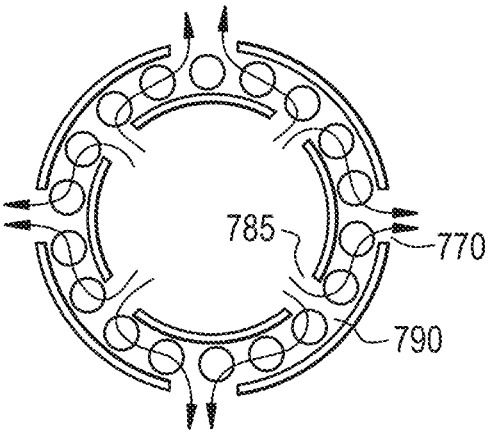
FIG. 13 is a cross-sectional view of a flavor cartridge according to at least one example embodiment.

FIG. 13 is a cross-sectional view of a flavor cartridge according to at least one example embodiment.

As shown in FIG. 13, in some example embodiments, the perforations 785 in the wall 792 of the inner housing 780 do not align with the perforations 770 in the wall 775 of the outer housing 765, such that a tortuous flow path is formed through the flavor chamber 790.

Figure 14:
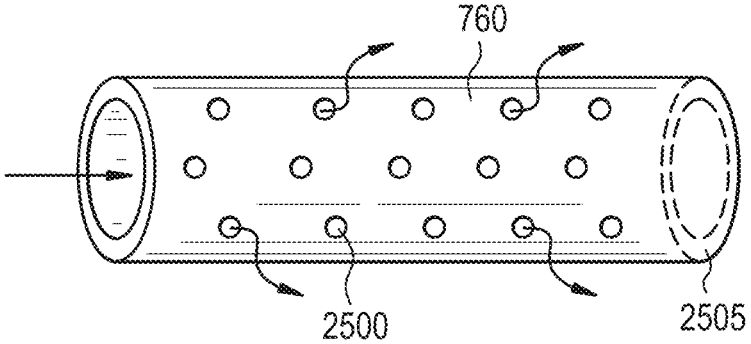
FIG. 14 is a perspective view of a flavor cartridge according to at least one example embodiment.

FIG. 14 is a perspective view of at least a portion of a flavor cartridge according to at least one example embodiment.

In at least one example embodiment, as shown in FIG. 14, one or more features of a flavor carrier 760 are generally the same as one or more features that have been described herein, except that instead of including the outer housing 765 and the inner housing 780 with a flavor chamber 790 therebetween, the flavor carrier 760 is formed of a tube 2505 of paper impregnated with at least one flavorant. The tube 2505 has a thickness that is about the same as the gap between the outer housing 765 and the inner housing 780 as described herein. The tube 2505 includes a plurality of perforations 2500 therein. The perforations 2500 may be in any desired shape and/or configuration.

Figure 15:
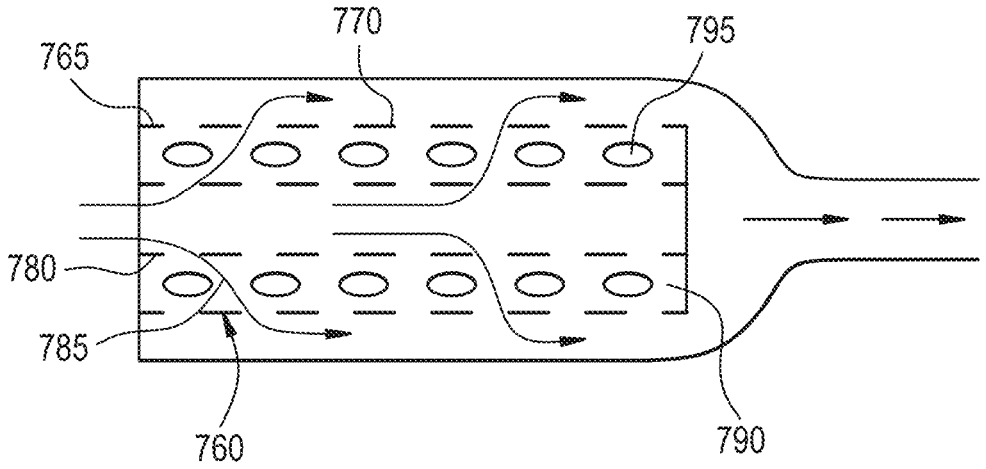
FIG. 15 is an illustration of airflow through a flavor carrier according to at least one example embodiment.

FIG. 15 is an illustration of airflow through a flavor carrier according to at least one example embodiment.

In one example embodiment shown in FIG. 15, vapor (shown by the arrows) generated by a vaporizer of an electronic vaping device enters the inner housing 780 and flows laterally through inner housing perforations 785, through flavor material 795 in flavor chamber 790, and through outer housing perforations 770 into a space between outer housing 765 and an outer housing of the electronic vaping device, and exits through a mouth end of the electronic vaping device. As the vapor passes through the flavor material 795, aromas, flavors and/or components from flavor material 795 may be eluted to the vapor. In some example embodiments, some of the vapor or vapor components may be filtered out as the vapor flows through the flavor carrier 760.

In some example embodiments, not shown, the flavor carrier may include one or more feature from one or more embodiments described herein.

Example embodiments have been disclosed herein, it should be understood that other variations may be possible. Such variations are not to be regarded as a departure from the spirit and scope of the present disclosure, and all such modifications as would be obvious to one skilled in the art are intended to be included within the scope of the following claims.

We claim:

1. A cartridge of an electronic vaping device, the cartridge comprising:
- a mouthpiece;
- a vaporizer in the cartridge;
- a flavor carrier including,
  - an outer flavor carrier housing, the outer flavor carrier housing defining a first plurality of perforations,
  - an inner flavor carrier housing coaxial with the outer flavor carrier housing, the inner flavor carrier housing defining a second plurality of perforations, the outer flavor carrier housing and the inner flavor carrier housing defining a flavor chamber therebetween,
- a first cover at a first end of the flavor carrier, and
- a second cover at a second end of the flavor carrier; and
- an adapter surrounding at least a portion of the flavor carrier, the flavor carrier and the adapter between the mouthpiece and the vaporizer.

2. The cartridge of claim 1, wherein the mouthpiece is at an end of the flavor carrier opposite the adapter.

3. The cartridge of claim 1, wherein the mouthpiece is coupled to the adapter.

4. The cartridge of claim 1, wherein the flavor chamber is configured to contain a flavoring material, the flavoring material including a botanical material, a gel, a film, flavor bits, a powder, a compressed powder, a flavor bead, or any combination thereof.

5. The cartridge of claim 1, wherein the first cover is configured to secure the flavor carrier within an outer cartridge housing of the cartridge, the outer flavor carrier housing having a smaller outer diameter than an inner diameter of the outer cartridge housing.

6. The cartridge of claim 1, wherein the first cover defines a channel therein, the channel in fluid communication with an air passage defined by the inner flavor carrier housing.

7. The cartridge of claim 1, wherein the first cover, the second cover, or both the first cover and the second cover is formed of one or more materials including a polymer, a metal, or both a polymer and a metal, the first cover, the second cover, or both the first cover and the second cover being impermeable to vapor.

8. The cartridge of claim 1, wherein the second cover comprises a gasket, the gasket being impermeable to vapor.

9. The cartridge of claim 8, wherein the gasket is formed of one or more materials including a polymer, a metal, or both a polymer and a metal.

10. The cartridge of claim 1, wherein the first plurality of perforations is misaligned with the second plurality of perforations.

11. A cartridge of an electronic vaping device, the cartridge comprising:
- a mouthpiece;
- a vaporizer in the cartridge;
- a flavor carrier including,
  - an outer flavor carrier housing, the outer flavor carrier housing defining a first plurality of perforations, and
  - an inner flavor carrier housing coaxial with the outer flavor carrier housing, the inner flavor carrier housing defining a second plurality of perforations, the outer flavor carrier housing and the inner flavor carrier housing defining a flavor chamber therebetween, the first plurality of perforations aligned with the second plurality of perforations; and
- an adapter surrounding at least a portion of the flavor carrier, the flavor carrier and the adapter between the mouthpiece and the vaporizer.

12. A cartridge of an electronic vaping device, the cartridge comprising:
- a mouthpiece;
- a vaporizer in the cartridge;
- a flavor carrier including,
  - an outer flavor carrier housing, the outer flavor carrier housing defining a first plurality of perforations, and
  - an inner flavor carrier housing coaxial with the outer flavor carrier housing, the inner flavor carrier housing defining a second plurality of perforations, the outer flavor carrier housing and the inner flavor carrier housing defining a flavor chamber therebetween, the first plurality of perforations including a rectangular shape and extending parallel to a longitudinal direction of the outer flavor carrier housing; and
- an adapter surrounding at least a portion of the flavor carrier, the flavor carrier and the adapter between the mouthpiece and the vaporizer.

13. A cartridge of an electronic vaping device, the cartridge comprising:
- a mouthpiece;
- a vaporizer in the cartridge;
- a flavor carrier including,
  - an outer flavor carrier housing, the outer flavor carrier housing defining a first plurality of perforations, and
  - an inner flavor carrier housing coaxial with the outer flavor carrier housing, the inner flavor carrier housing defining a second plurality of perforations, the outer flavor carrier housing and the inner flavor carrier housing defining a flavor chamber therebetween, the first plurality of perforations including a rectangular shape and extending perpendicular to a longitudinal direction of the outer flavor carrier housing; and
- an adapter surrounding at least a portion of the flavor carrier, the flavor carrier and the adapter between the mouthpiece and the vaporizer.

14. An electronic vaping device, comprising:
- a cartridge including,
  - a mouthpiece,
  - a flavor carrier including,
    - an outer flavor carrier housing, the outer flavor carrier housing defining a first plurality of perforations,
    - an inner flavor carrier housing coaxial with the outer flavor carrier housing, the inner flavor carrier housing defining a second plurality of perforations, the outer flavor carrier housing and the inner flavor carrier housing defining a flavor chamber, a first cover at a first end of the flavor carrier, and a second cover at a second end of the flavor carrier, an adapter surrounding at least a portion of the flavor carrier, and a vaporizer, the flavor carrier between the vaporizer and the mouthpiece; and a power supply housing including a power supply, the cartridge configured to be removably coupled to the power supply housing.

15. The electronic vaping device of claim 14, wherein the mouthpiece is removably coupled to an end of the cartridge opposite the power supply housing.

16. The electronic vaping device of claim 14, wherein the flavor chamber is configured to contain a flavoring material, the flavoring material including a botanical material, a gel, a film, flavor bits, a powder, a compressed powder, a flavor bead, or any combination thereof.

17. The electronic vaping device of claim 14, wherein the first plurality of perforations is misaligned with the second plurality of perforations.

18. An electronic vaping device, comprising:

a cartridge including, a mouthpiece, a flavor carrier including, an outer flavor carrier housing, the outer flavor carrier housing defining a first plurality of perforations, and an inner flavor carrier housing coaxial with the outer flavor carrier housing, the inner flavor carrier housing defining a second plurality of perforations, the outer flavor carrier housing and the inner flavor carrier housing defining a flavor chamber, the first plurality of perforations aligned with the second plurality of perforations, an adapter surrounding at least a portion of the flavor carrier, and a vaporizer, the flavor carrier between the vaporizer and the mouthpiece; and a power supply housing including a power supply, the cartridge configured to be removably coupled to the power supply housing.

19. An electronic vaping device, comprising:

a cartridge including, a mouthpiece, a flavor carrier including, an outer flavor carrier housing, the outer flavor carrier housing defining a first plurality of perforations, and an inner flavor carrier housing coaxial with the outer flavor carrier housing, the inner flavor carrier housing defining a second plurality of perforations, the outer flavor carrier housing and the inner flavor carrier housing defining a flavor chamber, the first plurality of perforations including a rectangular shape and extending parallel to a longitudinal direction of the outer flavor carrier housing, an adapter surrounding at least a portion of the flavor carrier, and a vaporizer, the flavor carrier between the vaporizer and the mouthpiece; and a power supply housing including a power supply, the cartridge configured to be removably coupled to the power supply housing.

20. An electronic vaping device, comprising:

a cartridge including, a mouthpiece, a flavor carrier including, an outer flavor carrier housing, the outer flavor carrier housing defining a first plurality of perforations, and an inner flavor carrier housing coaxial with the outer flavor carrier housing, the inner flavor carrier housing defining a second plurality of perforations, the outer flavor carrier housing and the inner flavor carrier housing defining a flavor chamber, the first plurality of perforations including a rectangular shape and extending perpendicular to a longitudinal direction of the outer flavor carrier housing, an adapter surrounding at least a portion of the flavor carrier, and a vaporizer, the flavor carrier between the vaporizer and the mouthpiece; and a power supply housing including a power supply, the cartridge configured to be removably coupled to the power supply housing.

* * * * *